US010370747B2

(12) United States Patent
Imataka et al.

(10) Patent No.: US 10,370,747 B2
(45) Date of Patent: Aug. 6, 2019

(54) NITRIDED COMPONENT

(71) Applicants: NIPPON STEEL & SUMITOMO METAL CORPORATION, Tokyo (JP); HONDA MOTOR CO., LTD., Tokyo (JP)

(72) Inventors: Hideki Imataka, Tokyo (JP); Masato Yuya, Tokyo (JP); Yuya Gyotoku, Tokyo (JP); Atsushi Kobayashi, Saitama (JP); Susumu Maeda, Saitama (JP)

(73) Assignees: NIPPON STEEL CORPORATION, Tokyo (JP); HONDA MOTOR CO., LTD., Tokyo (JP)

( * ) Notice: Subject to any disclaimer, the term of this patent is extended or adjusted under 35 U.S.C. 154(b) by 219 days.

(21) Appl. No.: 15/623,434

(22) Filed: Jun. 15, 2017

(65) Prior Publication Data

US 2017/0283922 A1 Oct. 5, 2017

Related U.S. Application Data

(62) Division of application No. 13/982,594, filed as application No. PCT/JP2012/051650 on Jan. 26, 2012, now abandoned.

(30) Foreign Application Priority Data

Feb. 1, 2011 (JP) ..... 2011-019868

(51) Int. Cl.

| | |
|---|---|
| ***C22C 38/50*** | (2006.01) |
| ***C21D 1/06*** | (2006.01) |
| ***C21D 9/32*** | (2006.01) |
| ***C22C 38/02*** | (2006.01) |
| ***C22C 38/04*** | (2006.01) |
| ***C22C 38/06*** | (2006.01) |
| ***C22C 38/24*** | (2006.01) |
| ***C23C 8/26*** | (2006.01) |
| ***C22C 38/00*** | (2006.01) |
| ***C22C 38/20*** | (2006.01) |
| ***C22C 38/22*** | (2006.01) |
| ***C22C 38/28*** | (2006.01) |
| ***C22C 38/44*** | (2006.01) |
| ***C22C 38/46*** | (2006.01) |

(52) U.S. Cl.

CPC ..... *C22C 38/50* (2013.01); *C21D 1/06* (2013.01); *C21D 9/32* (2013.01); *C22C 38/001* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/28* (2013.01); *C22C 38/44* (2013.01); *C22C 38/46* (2013.01); *C23C 8/26* (2013.01)

(58) Field of Classification Search

CPC ..... C22C 38/50; C22C 38/001; C22C 38/02; C21D 1/06; C21D 9/32

USPC ..... 148/318

See application file for complete search history.

(56) References Cited

U.S. PATENT DOCUMENTS

| | | | |
|---|---|---|---|
| 8,328,956 | B2 | 12/2012 | Kozawa et al. |
| 2006/0219332 | A1 | 10/2006 | Murase et al. |
| 2010/0139811 | A1 | 6/2010 | Kozawa et al. |
| 2012/0063945 | A1 | 3/2012 | Tsuchida |

FOREIGN PATENT DOCUMENTS

| | | |
|---|---|---|
| CN | 101688279 | 3/2010 |
| JP | 05-171347 | 7/1993 |
| JP | 09-071841 | 3/1997 |
| JP | 09-279296 | 10/1997 |
| JP | 2005-281857 | 10/2005 |
| JP | 2006-193827 | 7/2006 |
| JP | 2006-249504 | 9/2006 |
| JP | 2006-348321 | 12/2006 |
| JP | 2009-030134 | 2/2009 |
| WO | 2010/140596 | 12/2010 |

*Primary Examiner* — Edward M Johnson

(74) *Attorney, Agent, or Firm* — Clark & Brody

(57) ABSTRACT

A nitrided component has a chemical composition consisting of, by mass percent, C: 0.07-0.14%, Si: 0.10-0.30%, Mn: 0.4-1.0%, S: 0.005-0.030%, Cr: 1.0-1.5%, Mo: ≤0.05% (including 0%), Al: 0.010% or more to less than 0.10%, V: 0.10-0.25%, optionally at least one element selected from Cu: ≤0.30% and Ni: ≤0.25%, [0.61Mn+1.11Cr+0.35Mo+0.47V≤2.30], and the balance of Fe and impurities. P, N, Ti and O among the impurities are P: ≤0.030%, N: ≤0.008%, Ti: ≤0.005%, and O: ≤0.0030%. The nitrided composition is suitable for use as an automobile ring gear. The nitrided component has a surface hardness of 650-900 HV, core hardness being ≥150 HV, effective case depth of ≥0.15 mm, has excellent bending fatigue strength and surface fatigue strength although the content of Mo is as low as ≤0.05% and has a small amount of expansion caused by nitriding.

2 Claims, 6 Drawing Sheets

NITRIDED COMPONENT

TECHNICAL FIELD

The present invention relates to a steel for nitriding and a component having been nitrided (hereinafter, referred to as a nitrided component). More particularly, it relates to a steel for nitriding that is suitable for being used as a material for a nitrided component such as an automobile ring gear, which steel is easily subjected to cutting before nitriding, has a high bending fatigue strength and surface fatigue strength after nitriding, and further can suppress expansion (heat treatment distortion) caused by nitriding, and a nitrided component produced by using the steel.

BACKGROUND ART

A component used for an automobile transmission is usually subjected to casehardening treatment such as carburizing-quenching, induction hardening, or nitriding from the viewpoint of improvement in bending fatigue strength and surface fatigue strength.

Among these treatments, the "carburizing-quenching" is a treatment in which a low carbon steel is generally used, and after C has intruded and diffused in an austenite zone of a high temperature of $Ac_3$ point or higher, quenching is performed. This treatment has an advantage of being capable of obtaining a high surface hardness and a large case depth, but has a problem of a large heat treatment distortion because this treatment is associated with transformation. Therefore, in the case where a high component accuracy is required, finishing such as grinding or honing is needed after carburizing-quenching. Also, this treatment has a problem that the fatigue strength is decreased with a so-called "nonmartensitic layer" such as a grain boundary oxidized layer or an incompletely quenched layer, which is formed on an outer layer, being a fracture starting point of bending fatigue and the like.

The "induction hardening" is a treatment in which quenching is performed by rapidly heating a steel to an austenite zone of a high temperature of $Ac_3$ point or higher and by cooling it. This treatment has an advantage that the case depth can be regulated with relative ease, but is not a casehardening treatment in which C is intruded and diffused as in carburization. Therefore, to obtain a necessary surface hardness, case depth, and core hardness, a medium carbon steel having a C content higher than that of a steel for carburizing is generally used. However, the medium carbon steel has a problem of decreased machinability because the hardness thereof is higher than that of the low carbon steel. Also, this treatment has a problem that a high-frequency heating coil must be prepared for each component.

The "nitriding" is a treatment in which a high surface hardness and a proper case depth are obtained by intrusion and diffusion of N at a temperature of about 450 to 650° C. that is not higher than the $Ac_1$ point. The nitriding treatment has an advantage that the heat treatment distortion is small even if a steel is, for example, oil-cooled because the treatment temperature of nitriding is lower than the treatment temperatures of carburizing-quenching and induction hardening.

Especially, of the "nitriding", "nitrocarburizing" is a treatment in which a high surface hardness is obtained by intrusion and diffusion of N and C at a temperature of about 500 to 600° C. that is not higher than the $Ac_1$ point. This treatment is suitable for mass production because not only the heat treatment distortion is small but also the treatment time is several hours, being shorter than that in the case where only N is intruded and diffused.

However, the conventional steel for nitriding has the problems described in the following (1) to (4).

(1) Since nitriding is a treatment in which quenching treatment from a high-temperature austenite zone is not performed, strengthening associated with martensitic transformation cannot be applied. Therefore, in order to provide a nitrified component with a desired strength, it is necessary to increase the hardness before nitriding. However, in the case where the hardness is increased by containing a large amount of alloying element, the cutting becomes difficult to perform.

(2) The aluminum chromium molybdenum steel (SACM645) specified in JIS G 4053 (2008), which is a typical steel for nitriding, can provide a high surface hardness because Cr, Al, and the like form nitrides near the surface. However, since the case depth is shallow, a high surface fatigue strength cannot be provided. Also, if the surface hardness is too high, the damage against a pair-gear becomes undesirably high.

(3) Mo (molybdenum) is an element that combines with C in steel at the nitriding temperature to form carbides, and thereby improves the core hardness after nitriding. However, since Mo is an expensive element, the use of a large amount of Mo is unfavorable in terms of economy.

(4) Also, although the heat treatment distortion of nitriding is smaller than that of carburizing quenching and induction hardening, in the case where an alloying element is contained to provide a nitrided component with a desired strength, large amounts of alloy nitrides are formed by nitriding, and the surface of the nitrided component expands. Therefore, even in nitriding, the amount of heat treatment distortion undesirably increases. In particular, an automobile ring gear poses a problem even if being subjected to slight heat treatment distortion because the automobile ring gear is nitrided after having been machined into a thin-wall final shape and having been subjected to gear cutting.

Concerning a material for nitrided component, the techniques described in, for example, Patent Documents 1 and 2 have been proposed.

Patent Document 1 discloses a "material for nitrided component excellent in broaching workability" consisting, by mass percent, of C: 0.10 to 0.40%, Si: 0.50% or less, Mn: 0.30 to 1.50%, Cr: 0.30 to 2.00%, V: more than 0.15% to 0.50%, and Al: 0.02 to 0.50%, further containing, as necessary, one element or two or more elements of Ni: 2.00% or less, Mo: 0.50% or less, S: 0.20% or less, Bi: 0.30% or less, Se: 0.30% or less, Ca: 0.10% or less, Te: 0.30% or less, Nb: 0.50% or less, and Ti: 1.00% or less, the balance of Fe and impurities, and consisting of a ferritic-pearlitic structure having a ferrite hardness of HV190 or higher, and a "method for producing nitrided component" using the material.

Patent Document 2 discloses a "material for nitrided component excellent in broaching workability" consisting, by mass percent, of C: 0.10 to 0.40%, Si: 0.50% or less, Mn: 0.30 to less than 1.50%, Cr: 0.30 to 2.00%, and Al: 0.02 to 0.50%, further containing, as necessary, one element or two or more elements of Ni: 2.00% or less, Mo: 0.50% or less, S: 0.20% or less, Bi: 0.30% or less, Se: 0.30% or less, Ca: 0.10% or less, Te: 0.30% or less, Nb: 0.50% or less, Ti: 1.00% or less, and V: 0.50% or less, the balance of Fe and impurities, and consisting of a bainitic structure having a hardness of HV210 or higher, and a "method for producing nitrided component" using the material.

LIST OF PRIOR ART DOCUMENTS

Patent Document

Patent Document 1: JP2005-281857A
Patent Document 2: JP2006-249504A

DISCLOSURE OF THE INVENTION

Problems to be Solved by the Invention

In the material for a nitrided component proposed in Patent Document 1, the ferrite hardness before nitriding treatment is as high as 192 or higher in Vickers hardness (hereinafter, the "Vickers hardness" is sometimes referred to as an "HV") as shown in Example of Patent Document 1. Therefore, this material is not excellent in machinability in the case where the cutting speed is high.

In the material for a nitrided component proposed in Patent Document 2 as well, the bainite hardness before nitriding treatment is as high as 218 or higher in Vickers hardness as shown in Example of Patent Document 2, so that it is difficult to say that this material is excellent in machinability in the case where the cutting speed is high.

The present invention has been made in view of the above present situation, and accordingly an objective thereof is to provide a steel for nitriding that is suitable for being used as a material for a nitrided component, which steel is easily subjected to cutting before nitriding, and moreover, has a high bending fatigue strength and surface fatigue strength after nitriding and further is configured so that expansion (heat treatment distortion) caused by nitriding can be suppressed even if the content of Mo, which is an expensive element, is restricted to 0.05 mass % or less, and a nitrided component produced by using the steel.

Means for Solving the Problems

To solve the problems, the present inventors conducted various studies. As the result, the findings of (a) to (d) described below have been obtained.

(a) The machinability before nitriding treatment is improved by reducing the C content as much as possible and by keeping the Mo content low.

(b) The decrease in strength caused by the decrease in the C content can be compensated by increasing the Mn content and/or the Cr content and by containing V.

(c) The formation of hard inclusions (TiN) exerting an adverse influence on the bending fatigue strength and surface fatigue strength can be suppressed by restricting the Ti content and the N content.

(d) The crystal lattice is distorted by the alloy nitrides formed by nitriding, and the component surface expands, thereby producing heat treatment distortion. This expansion (heat treatment distortion) caused by nitriding can be suppressed by properly regulating the contents of Mn, Cr, Mo and V that form alloy nitrides when nitriding is performed.

The present invention has been completed based on the above-described findings, and involves steels for nitriding described in (1) and (2), and a nitrided component described in (3).

(1) A steel for nitriding having a chemical composition consisting of, by mass percent, C: 0.07 to 0.14%, Si: 0.10 to 0.30%, Mn: 0.4 to 1.0%, S: 0.005 to 0.030%, Cr: 1.0 to 1.5%, Mo: 0.05% or less (including 0%), Al: 0.010% or more to less than 0.10%, and V: 0.10 to 0.25%, Fn1 expressed by Formula (1) is 2.30 or less, and the balance of Fe and impurities, wherein P, N, Ti and O among the impurities are P: 0.030% or less, N: 0.008% or less, Ti: 0.005% or less, and O: 0.0030% or less:

$$Fn1=0.61Mn+1.11Cr+0.35Mo+0.47V \quad (1)$$

where, the symbol of each element in Formula (1) represents the content thereof in mass percent.

(2) The steel for nitriding according to (1) having a chemical composition containing, in lieu of a part of Fe, at least one element selected from, by mass percent, Cu: 0.30% or less and Ni: 0.25% or less.

(3) A nitrified component having the chemical composition according to (1) or (2), in which the surface hardness is 650 to 900 in Vickers hardness, the core hardness is 150 or higher in Vickers hardness, and the effective case depth is 0.15 mm or larger.

In the present invention, the "nitriding" is not only a treatment in which only N is intruded and diffused, but includes "nitrocarburizing" that is a treatment in which N and C are intruded and diffused. That is, the "nitriding" in the present invention includes not only "2411 nitriding" specified in JIS B 6905 (1995) but also "2421 nitrocarburizing" specified therein.

The "impurities" in the "Fe and impurities" described as the balance mean elements that mixedly enter from raw materials, such as ore or scrap, or production environments when steel materials are produced on an industrial scale.

Also, the "surface hardness" means an arithmetic mean value of the values obtained by measuring Vickers hardnesses at optional ten points at a position 0.03 mm deep from the surface of a test specimen by using a Vickers hardness tester with the test force being 0.98 N in conformity to "Vickers hardness test—test method" described in JIS Z 2244 (2009).

The "effective case depth" means a distance from the surface to a position at which the Vickers hardness is 420, which distance is determined by using a distribution chart of Vickers hardness (that is, a transition curve of Vickers hardness) at the time when measurement is made at predetermined intervals from the test specimen surface with the test force being 1.96 N.

Advantageous Effects of the Invention

For the steel for nitriding of the present invention, cutting before nitriding is easy to perform, and also the amount of expansion caused by nitriding is small. Moreover, the nitrided component produced by using this steel as a material is provided with a high bending fatigue strength and surface fatigue strength although the content of Mo, which is an expensive element, is as low as 0.05 mass % or less.

BRIEF DESCRIPTION OF THE DRAWINGS

FIG. 4(*a*) is a front view in the case where the roller pitching large roller test specimen having the rough shape is cut in half on the centerline, and FIG. 4(*b*) is a sectional view taken on the centerline. The unit of each dimension in the figure is "mm".

FIG. 10(*a*) is a front view in the case where the roller pitching large roller test specimen is cut in half on the centerline, and FIG. 10(*b*) is a sectional view taken on the centerline. The unit of each dimension in the figure is "mm".

FIG. 11(*a*) shows a state before "gas nitrocarburizing" or "carburizing-quenching-tempering", and FIG. 11(*b*) shows a state during the time from "gas nitrocarburizing" to oil cooling or a state after "carburizing-quenching-tempering".

MODE FOR CARRYING OUT THE INVENTION

Figure 1:
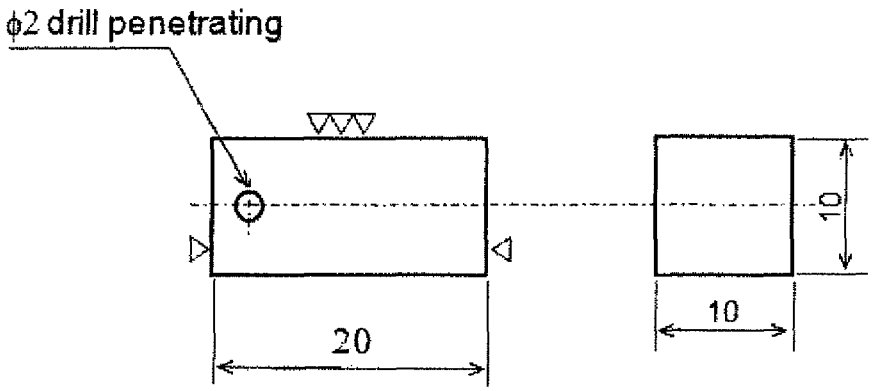
FIG. 1 is views showing the shape of an expansion measuring test specimen that is used in Example. The unit of each dimension in the figure is "mm".

In the following, the requirements of the present invention are explained in detail. In the explanation below, symbol "%" concerning the content of each element means "percent by mass".

(A) Chemical Composition of Steel

C: 0.07 to 0.14%

C (carbon) is an element essential for ensuring the strength of nitrided component, and 0.07% or more of C must be contained. However, if the C content increases and exceeds 0.14%, the hardness before nitriding increases, resulting in a decrease in machinability. Therefore, the C content is 0.07 to 0.14%. In order to ensure the strength of nitrided component more stably, the C content is preferably 0.09% or more. Also, when importance is attached to the machinability, the C content is preferably 0.12% or less.

Si: 0.10 to 0.30%

Si (silicon) is a deoxidizing element. In order to achieve this effect, 0.10% or more of Si must be contained. However, if the Si content increases and exceeds 0.30%, the hardness before nitriding increases, resulting in a decrease in machinability. Therefore, the Si content is 0.10 to 0.30%. The Si content is preferably 0.12% or more, and is preferably 0.25% or less.

Mn: 0.4 to 1.0%

Mn (manganese) has an action for ensuring the bending fatigue strength and surface fatigue strength of nitrided component, and also is a deoxidizing element. In order to achieve these effects, 0.4% or more of Mn must be contained. However, if the Mn content increases and exceeds 1.0%, the hardness before nitriding increases excessively, resulting in a decrease in machinability. Therefore, the Mn content is 0.4 to 1.0%. In order to ensure the strength of nitrified component more stably, the Mn content is preferably 0.5% or more. Also, when importance is more attached to the machinability, the Mn content is preferably 0.6% or less.

S: 0.005 to 0.030%

S (sulfur) combines with Mn to form MnS, so that S has an action for improving the machinability. However, if the S content is less than 0.005%, the above-described effect cannot be achieved. On the other hand, if the S content exceeds 0.030%, coarse MnS is formed, so that the hot forgeability and bending fatigue strength decrease. Therefore, the S content is 0.005 to 0.030%. In order to ensure the machinability more stably, the S content is preferably 0.010% or more. Also, when importance is more attached to the hot forgeability and bending fatigue strength, the S content is preferably 0.025% or less.

Cr: 1.0 to 1.5%

Cr (chromium) has actions for increasing the surface hardness and core hardness in nitriding and for ensuring the bending fatigue strength and surface fatigue strength of component. However, if the Cr content is less than 1.0%, the above-described effects cannot be achieved. On the other hand, if the Cr content increases and exceeds 1.5%, the hardness before nitriding increases, resulting in a decrease in machinability. Therefore, the Cr content is 1.0 to 1.5%. In order to increase the surface hardness and core hardness in nitriding more stably, the Cr content is preferably 1.1% or more. Also, when importance is more attached to the machinability, the Cr content is preferably 1.4% or less.

Mo: 0.05% or less (including 0%)

Mo (molybdenum) need not necessarily be contained. If Mo is contained, Mo combines with C in steel at the nitriding temperature to form carbides, so that the core hardness after nitriding is improved. However, if the Mo content increases and exceeds 0.05%, not only the raw material cost goes up but also the hardness before nitriding increases, resulting in a decrease in machinability. Therefore, the Mo content is 0.05% or less. When importance is attached to the machinability, the Mo content is preferably 0.03% or less.

Al: 0.010% or more to less than 0.10%

Al (aluminum) is a deoxidizing element. Also, Al combines with N that intrudes and diffuses from the surface at the time of nitriding to form AlN, so that Al has an action for improving the surface hardness. In order to achieve these effects, 0.010% or more of Al must be contained. However, if the Al content increases and becomes 0.10% or more, not only the machinability is decreased by the formation of hard $Al_2O_3$, but also there arises a problem that the nitrided case depth becomes shallow and thereby the bending fatigue strength and surface fatigue strength are decreased. Therefore, the Al content is 0.010% or more to less than 0.10%. The preferable lower limit of Al content is 0.020%, and also the preferable upper limit thereof is 0.070%.

V: 0.10 to 0.25%

V (vanadium), like Mo, combines with C in steel at the nitriding temperature to form carbides, so that V has an action for improving the core hardness after nitriding. Also, V combines with N and/or C, which intrude and diffuse from the surface at the time of nitriding, to form nitrides and/or carbo-nitrides, so that V also has an action for improving the surface hardness. In order to achieve these effects, 0.10% or more of V must be contained. However, if the V content increases and exceeds 0.25%, the hardness before nitriding becomes too high, so that not only the machinability decreases, but also the above-described effects saturate because V does not dissolve in a matrix in hot forging and the subsequent normalizing. Therefore, the V content is 0.10 to 0.25%. The V content is preferably 0.15% or more and 0.20% or less.

Fn1: 2.30 or less

The alloying element having a strong affinity for nitrogen combines with nitrogen when nitriding is performed, and forms alloy nitrides in a near-surface portion. Since the alloy nitrides distort the crystal lattice, the component surface expands, and the heat treatment distortion occurs. Especially for Mn, Cr, Mo and V, the alloy nitrides are easily precipitated in the near-surface portion. In some cases, therefore, the expansion (heat treatment distortion) caused by nitriding cannot be suppressed even though the contents of these elements are within the above-described ranges. However, if Fn1 expressed by Formula (1) is 2.30 or less, the excessive precipitation of alloy nitrides in nitriding is suppressed, and thus, the amount of expansion in nitriding becomes small and the heat treatment distortion can be suppressed.

$$Fn1=0.61Mn+1.11Cr+0.35Mo+0.47V \quad (1)$$

where, the symbol of each element in Formula (1) represents the content thereof by mass percent.

Therefore, for Mn, Cr, Mo and V, the contents are made within the already-described ranges, and additionally are made such that the Fn1 is 2.30 or less. The Fn1 is preferably 1.50 or more and 2.20 or less.

In one of the steels for nitriding of the present invention, besides the containing of the above-described elements, the balance is Fe and impurities, wherein P, N, Ti and O among the impurities are P: 0.030% or less, N: 0.008% or less, Ti: 0.005% or less, and O: 0.0030% or less.

In the following, P, N, Ti and O among the impurities are explained.

P: 0.030% or less

P (phosphorus) is an impurity contained in a steel, and segregates at the crystal grain boundaries and embrittles the steel. In particular, if the P content exceeds 0.030%, the degree of embrittlement becomes sometimes remarkable. Therefore, in the present invention, the content of P in the impurities is 0.030% or less. The content of P in the impurities is preferably 0.020% or less.

N: 0.008% or less

N (nitrogen) in a steel combines with elements such as C and V and easily forms carbo-nitrides. If a carbo nitride such as VCN is formed before nitriding, the hardness increases, and the machinability decreases. Therefore, in the present invention, N is an unfavorable element. Also, since this carbo-nitride has a high solid solution temperature, V is less liable to be dissolved in a matrix by the heating in hot forging and the subsequent normalizing, and if the content of N in steel is high, the above-described effects of V due to nitriding cannot be achieved sufficiently. Therefore, in the present invention, the content of N in the impurities is 0.008% or less. The content of N in the impurities is preferably 0.006% or less.

Ti: 0.005% or less

Ti (titanium) has a high affinity for N, and combines with N in steel to easily form TiN, which is a hard nitride. If the Ti content exceeds 0.005%, the formed coarse TiN undesirably decreases the bending fatigue strength and surface fatigue strength. Therefore, in the present invention, the content of Ti in the impurities is 0.005% or less. The content of Ti in the impurities is preferably 0.003% or less.

O: 0.0030% or less

O (oxygen) forms oxide system inclusions, which are a cause for fatigue fracture occurring with the inclusion being a starting point, and undesirably decreases the bending fatigue strength and surface fatigue strength. In particular, if the O content exceeds 0.0030%, the fatigue strengths decrease remarkably. Therefore, in the present invention, the content of O in the impurities is 0.0030% or less. The content of O in the impurities is preferably 0.0020% or less.

As already described, the "impurities" mean elements that mixedly enter from raw materials, such as ore or scrap, or production environments when steel materials are produced on an industrial scale.

In another one of the steels for nitriding of the present invention, in lieu of a part of Fe, at least one element selected from Cu and Ni are contained.

In the following, explanation is given of the operational advantages and the reasons for restricting the contents of Cu and Ni, which are optional elements.

Cu: 0.30% or less

Cu (copper) has an action for improving the core hardness. Therefore, to achieve this effect, Cu may be contained. However, if the Cu content increases, the machinability decreases. Therefore, the content of Cu, if contained, is provided with an upper limit, and is 0.30% or less. The content of Cu, if contained, is preferably 0.20% or less.

On the other hand, to achieve the above-described effect of Cu stably, the content of Cu, if contained, is preferably 0.10% or more, further preferably 0.15% or more.

Ni: 0.25% or less

Ni (nickel) has an action for improving the core hardness. Therefore, to achieve this effect, Ni may be contained. However, if the Ni content increases, the machinability decreases. Therefore, the content of Ni, if contained, is provided with an upper limit, and is 0.25% or less. The content of Ni, if contained, is preferably 0.20% or less.

On the other hand, to achieve the above-described effect of Ni stably, the content of Ni, if contained, is preferably 0.05% or more, further preferably 0.10% or more.

For Cu and Ni, only either one element of them may be contained, or two elements of them may be contained compositely. The total content of these elements may be 0.55%, and is preferably 0.50% or less.

(B) Surface Hardness of Nitrided Component

For a nitrided component, that is, a component having been subjected to nitriding, if the surface hardness thereof is low, the bending fatigue strength, surface fatigue strength, and wear resistance undesirably decrease. However, if the surface hardness is 650 or higher in HV, the nitrided component can be provided with a desired strength. On the other hand, if the surface hardness increases and especially exceeds 900 in HV, the attack ability against a mating gear becomes undesirably high. Therefore, the surface hardness of nitrided component is 650 to 900 in HV. The preferable lower limit of surface hardness is 700 in HV, and the preferable upper limit thereof is 800 in HV.

(C) Core Hardness of Nitrided Component

If the core hardness of a nitrided component is low, plastic deformation occurs in the nitrided component when a load is applied to the component, pitting occurs on account of a crack generated in the component, and the surface fatigue strength undesirably decreases. In order to suppress the plastic deformation in the nitrided component, the core hardness must be 150 or higher in HV. Therefore, the core hardness of the nitrided component of the present invention is 150 or higher in HV. The preferable lower limit of the core hardness is 170 in HV.

The upper limit of core hardness need not be defined especially; however, the upper limit of the core hardness that can be attained when the steel for nitriding of the present invention is nitrided without being quenched is about 250 in HV.

(D) Effective Case Depth of Nitrided Component

If the effective case depth of a nitrided component is shallow, a fracture is generated with an internal portion being a starting point, and thereby the bending fatigue strength and surface fatigue strength are undesirably decreased. In order to suppress the fracture occurring with an internal portion being a starting point, the effective case depth must be 0.15 mm or larger. Therefore, the effective case depth of the nitrided component of the present invention is 0.15 mm or larger. The preferable lower limit of the effective case depth is 0.20 mm.

The upper limit of the effective case depth need not be defined especially. However, in order to increase the effective case depth, the nitriding treatment time must be prolonged, which results in an increase in cost. Therefore, the effective case depth is preferably 0.50 mm or less, further preferably 0.45 mm or less.

(E) Method for Producing Nitrided Component

The nitrided component of the present invention can be produced by subjecting the steel having the chemical composition described in (A) to working, heat treatment, and nitriding treatment under the conditions, for example, described below.

(E-1) Hot Forging

A billet, steel bar, or the like of the steel having the chemical composition described in (A) is cut, and thereafter is hot-forged into a rough shape by being heated to 1000 to 1270° C.

(E-2) Normalizing

The nitrided component of the present invention may be produced by being cut in a state of being hot-forged and by being subjected to nitriding treatment. However, if the component is normalized as necessary, the crystal grains thereof can be made finer. In this case, the normalizing treatment is preferably performed at a temperature of 850 to 970° C.

If slow cooling such as furnace cooling is performed in the cooling after normalizing, a carbo-nitride such as VCN precipitates in the cooling process, and thereby the hardness is increased, which sometimes results in a decrease in machinability. Therefore, in the cooling after normalizing, it is preferable that the precipitation of a carbo-nitride such as VCN in the cooling process be suppressed by taking a proper measure, for example, by performing cooling by wind.

In order to suppress the precipitation of a carbo-nitride such as VCN in the cooling process and to maintain the machinability, it is preferable that the lower limit of cooling rate be 0.5° C./sec, and the upper limit thereof be 5° C./sec.

(E-3) Cutting

The normalized component having a rough shape is cut by using a lathe or the like, and thereafter is worked into a finished shape of the nitrided component by using a broaching machine or a gear shaper.

(E-4) Nitriding

The method of nitriding treatment for obtaining the nitrided component of the present invention is not defined specifically, and gas nitriding treatment, salt bath nitriding treatment, ion nitriding treatment, or the like can be employed. The treatment temperature in nitriding treatment is preferably 500 to 650° C. In the case of nitrocarburizing treatment, for example, RX gas is used in addition to $NH_3$, and the treatment has only to be performed in an atmosphere in which the ratio of $NH_3$ to RX gas is 1:1.

The treatment time is different depending on the treatment temperature. In the case where the nitriding treatment is performed at 560° C., a desired surface hardness, core hardness, and effective case depth can be obtained in nine hours.

In the case where it is desired to suppress the formation of a brittle compound, it is preferable that fluorine gas be used as the preparation of nitriding treatment using $NH_3$, or a gaseous mixture of $NH_3$ and $H_2$ be used for nitriding treatment.

For the cooling after the nitriding treatment, an appropriate method such as furnace cooling or oil cooling may be used.

In the following, the present invention is explained more specifically by referring to Example in which gas nitrocarburizing is performed. The present invention is not limited to this Example.

EXAMPLES

Steels 1 to 13 having the chemical compositions given in Table 1 were melted by using a vacuum furnace, an atmospheric melting furnace, or a converter to prepare ingots or a cast piece.

Specifically, for Steels 1 to 9, 11, and 12, the steels were melted by using a 180-kg vacuum furnace, and thereafter ingots were prepared by ingot making.

For Steel 10, the steel was melted by using a 180-kg atmospheric melting furnace, and thereafter an ingot was prepared by ingot making.

For Steel 13, the steel was melted by using a 70-ton converter, and thereafter a cast piece was prepared by continuous casting.

Steels 1 to 5 in Table 1 are steels of inventive examples whose chemical compositions are within the range defined in the present invention, and on the other hand, Steels 6 to 13 are steels of comparative examples whose chemical compositions fall outside the range defined in the present invention.

Among the steels of comparative examples, Steel 13 is a steel corresponding to SCr420H specified in JIS G 4052 (2008).

[Table 1]

TABLE 1

| | | Chemical composition (in mass %, balance: Fe and impurities) | | | | | | | | | | | | | |
|---|---|---|---|---|---|---|---|---|---|---|---|---|---|---|---|
| | Steel | C | Si | Mn | P | S | Cr | Mo | Al | V | Ti | N | O | other | Fn1 |
| Inventive Examples | 1 | 0.09 | 0.10 | 0.54 | 0.012 | 0.022 | 1.20 | — | 0.027 | 0.13 | 0.003 | 0.0047 | 0.0009 | — | 1.72 |
| | 2 | 0.10 | 0.11 | 0.49 | 0.010 | 0.015 | 1.24 | — | 0.026 | 0.15 | 0.001 | 0.0056 | 0.0010 | — | 1.75 |
| | 3 | 0.10 | 0.15 | 1.00 | 0.014 | 0.015 | 1.24 | — | 0.030 | 0.15 | 0.002 | 0.0050 | 0.0010 | — | 2.06 |
| | 4 | 0.07 | 0.20 | 0.65 | 0.019 | 0.015 | 1.40 | 0.03 | 0.034 | 0.19 | 0.001 | 0.0070 | 0.0009 | — | 2.05 |

TABLE 1-continued

| | Steel | Chemical composition (in mass %, balance: Fe and impurities) | | | | | | | | | | | | | |
|---|---|---|---|---|---|---|---|---|---|---|---|---|---|---|---|
| | | C | Si | Mn | P | S | Cr | Mo | Al | V | Ti | N | O | other | Fn1 |
| | 5 | 0.12 | 0.19 | 0.95 | 0.014 | 0.023 | 1.15 | 0.04 | 0.028 | 0.22 | 0.002 | 0.0065 | 0.0011 | Cu: 0.24, Ni: 0.21 | 1.97 |
| Comparative Examples | 6 | 0.12 | 0.18 | 0.98 | 0.015 | 0.018 | 1.48 | 0.05 | 0.033 | 0.25 | 0.001 | 0.0060 | 0.0008 | — | *2.38 |
| | 7 | *0.25 | 0.25 | *1.80 | 0.015 | 0.025 | 1.45 | — | 0.035 | 0.23 | 0.001 | 0.0065 | 0.0008 | — | *2.82 |
| | 8 | *0.06 | 0.12 | 0.66 | 0.012 | *0.002 | *0.32 | — | 0.030 | 0.11 | 0.002 | 0.0053 | 0.0009 | — | 0.81 |
| | 9 | 0.11 | 0.28 | 0.95 | 0.014 | 0.022 | *0.58 | — | 0.029 | 0.11 | 0.002 | 0.0060 | 0.0010 | — | 1.28 |
| | 10 | 0.12 | 0.23 | 0.92 | 0.016 | 0.018 | 1.10 | 0.04 | 0.028 | 0.13 | *0.095 | *0.0195 | *0.0040 | — | 1.86 |
| | 11 | 0.08 | 0.11 | 0.62 | 0.014 | 0.015 | 1.02 | — | 0.054 | *0.03 | 0.001 | 0.0070 | 0.0010 | — | 1.52 |
| | 12 | 0.14 | 0.17 | *1.25 | 0.013 | 0.018 | 1.10 | *0.52 | 0.044 | 0.21 | 0.005 | 0.0054 | 0.0014 | — | 2.26 |
| | 13 | *0.20 | 0.24 | 0.85 | 0.015 | 0.012 | 1.22 | — | 0.029 | *— | 0.003 | *0.0120 | 0.0010 | — | 1.87 |

Fn1 = 0.61Mn + 1.11Cr + 0.35Mo + 0.47V

*indicates that chemical compositions fall outside the range defined in the present invention.

The ingots of Steels 1 to 12 were subjected to homogenizing treatment in which the steels were held at 1250° C. for 5 hours, and thereafter were hot-forged by being heated to 1200° C., whereby steel bars having diameters of 25 mm, 35 mm, and 60 mm, with a length of 1000 mm were prepared.

Also, the cast piece of Steel 13 was bloomed into a billet by being heated to 1250° C. for 3 hours, and thereafter was hot-forged by being heated to 1200° C., whereby steel bars having diameters of 25 mm, 35 mm, 60 mm, and 140 mm, with a length of 1000 mm were prepared.

Among the steel bars, the steel bars of Steels 3 to 13 having diameters of 25 mm, 35 mm, and 60 mm were subjected to "normalizing" in which the steel bars were held at 920° C. for 1 hour, and thereafter were cooled by wind.

Also, the steel bar of Steel 13 having a diameter of 140 mm was subjected to "normalizing" in which the steel bar was held at 900° C. for 4 hours, and thereafter was allowed to cool.

From the steel bars of Steels 1 and 2 in a state of being hot-forged and the steel bars of Steels 3 to 13 having been normalized, various test specimens were sampled. The surface fatigue strength was evaluated by the roller pitting test.

Specifically, first, the steel bar having a diameter of 25 mm was subjected to so-called "transverse cutting", that is, was cut perpendicularly to the axial direction (longitudinal direction). After a cut specimen had been embedded in a resin so that the cut surface was a surface to be examined, the cut surface was polished so as to be of mirror finish to prepare Vickers hardness test specimens and micro-structure observation specimens in a state of being hot-forged or having been normalized.

Also, from the steel bar having a diameter of 60 mm, a lathe turning test specimen with a diameter of 50 mm and a length of 490 mm was sampled.

Figure 2:
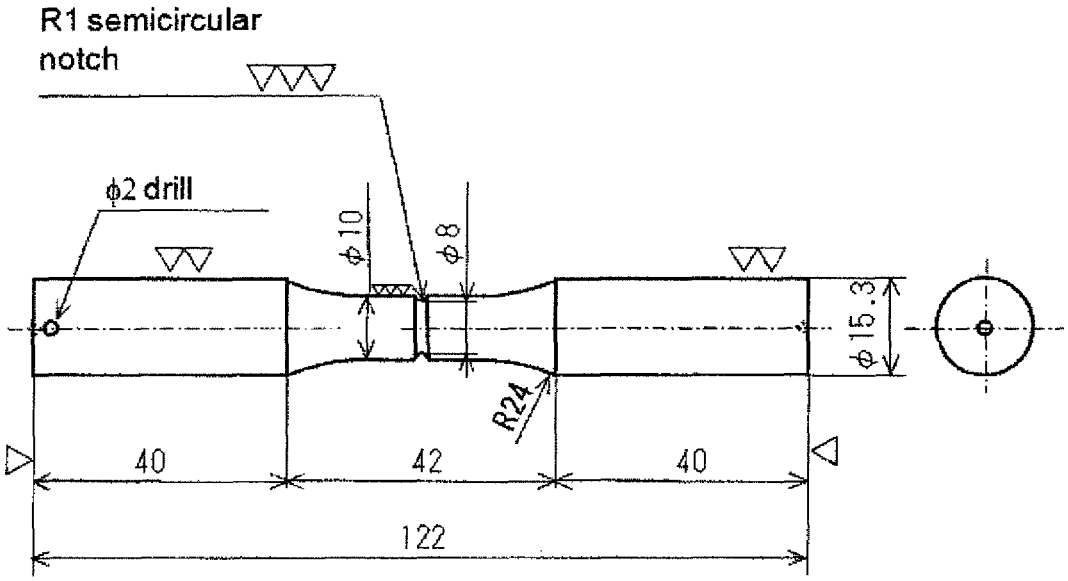
FIG. 2 is views showing the rough shape, in a state of being cut out of a steel bar, of a notched Ono type rotating bending fatigue test specimen that is used in Example. The unit of each dimension in the figure is "mm".
Figure 3:
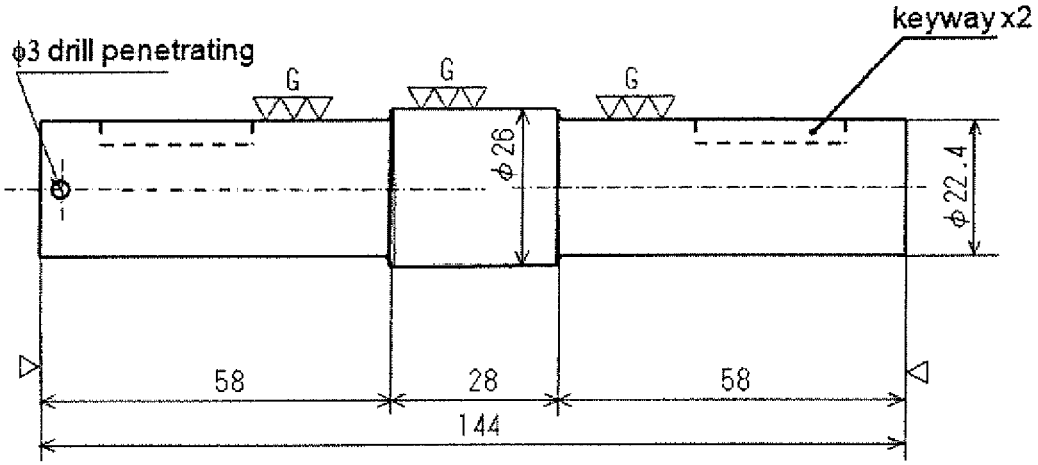
FIG. 3 is a view showing the rough shape, in a state of being cut out of a steel bar, of a roller pitching small roller test specimen that is used in Example. The unit of each dimension in the figure is "mm".

Further, from the central portion of the steel bar having a diameter of 25 mm, an expansion measuring test specimen shown in FIG. 1 and a notched Ono type rotating bending fatigue test specimen having a rough shape shown in FIG. 2 were cut out in parallel with the axial direction. Similarly, from the central portion of the steel bar having a diameter of 35 mm, a roller pitting small roller test specimen having a rough shape shown in FIG. 3 was cut out in parallel with the axial direction.

Figure 4:
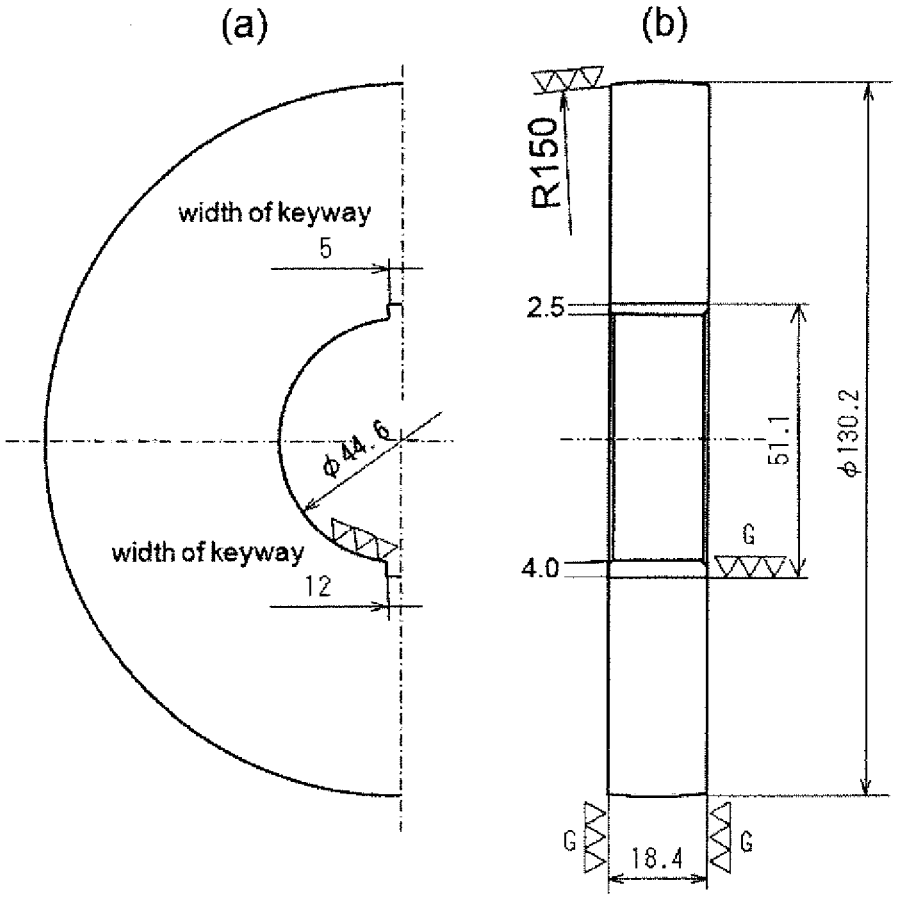
FIG. 4 is views showing the rough shape, in a state of being cut out of a steel bar, of a roller pitching large roller test specimen that is used in Example.

Also, from the central portion of the steel bar having a diameter of 140 mm, a roller pitting large roller test specimen having a rough shape shown in FIG. 4 was cut out in parallel with the axial direction. In FIG. 4, FIG. 4 (*a*) is a front view in the case where the rough shaped roller pitching large roller test specimen is cut in half on the centerline, and FIG. 4(*b*) is a sectional view taken on the centerline.

The units of all the dimensions of cut-out test specimens shown in FIGS. 1 to 4 are "mm". The finishing symbols of three kinds shown in FIGS. 1 to 4 are the "triangle symbols" representing surface roughness described in Explanation table 1 of JIS B 0601 (1982).

Also, letter "G" attached to the finishing symbol is an abbreviation of working method showing "grinding" specified in JIS B 0122 (1978).

Figure 5:
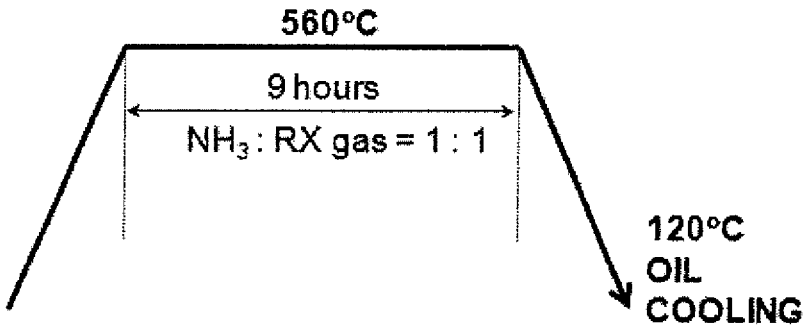
FIG. 5 is a diagram showing a heat pattern of "gas nitrocarburizing" and the subsequent cooling performed on the test specimens shown in FIGS. 1 to 3 using Steels 1 to 12 as materials in Example.

Among the test specimens having been prepared as described above, the rough shaped notched Ono type rotating bending fatigue test specimens and the rough shaped roller pitting small roller test specimens of Steels 1 to 12 were subjected to "gas nitrocarburizing" and "oil cooling" (hereinafter, referred to as "gas nitrocarburizing/oil cooling") in the heat pattern shown in FIG. 5. In FIG. 5, "120° C. OIL COOLING" indicates that cooling was performed by plunging the test specimen into oil with an oil temperature of 120° C.

Also, the expansion measuring test specimens of Steels 1 to 12 were subjected to "gas nitrocarburizing/oil cooling" in the heat pattern shown in FIG. 5 after indentations had been formed at a total of 32 places by using a Vickers hardness tester as described later.

Figure 6:
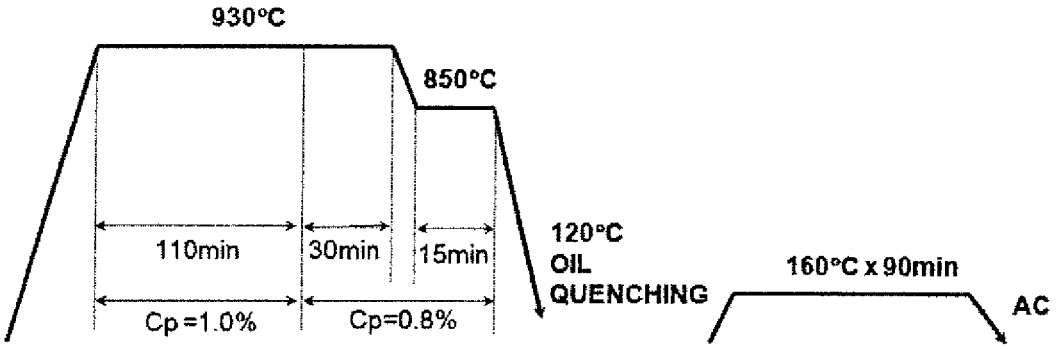
FIG. 6 is a diagram showing a heat pattern of "carburizing-quenching-tempering" performed on the test specimens shown in FIGS. 1 to 3 using Steel 13 as a material in Example.

On the other hand, the rough shaped notched Ono type rotating bending fatigue test specimen and the rough shaped roller pitting small roller test specimen of Steel 13 were subjected to "carburizing-quenching-tempering" in the heat pattern shown in FIG. 6. In FIG. 6, "Cp" represents carbon potential. Also, "120° C. OIL QUENCHING" indicates that quenching was performed by plunging the test specimen into oil with an oil temperature of 120° C. Further, "AC" represents air cooling.

Also, the expansion measuring test specimen of Steel 13 was subjected to "carburizing-quenching-tempering" in the heat pattern shown in FIG. 6 after indentations have been formed at a total of 32 places by using a Vickers hardness tester as described later.

Figure 7:
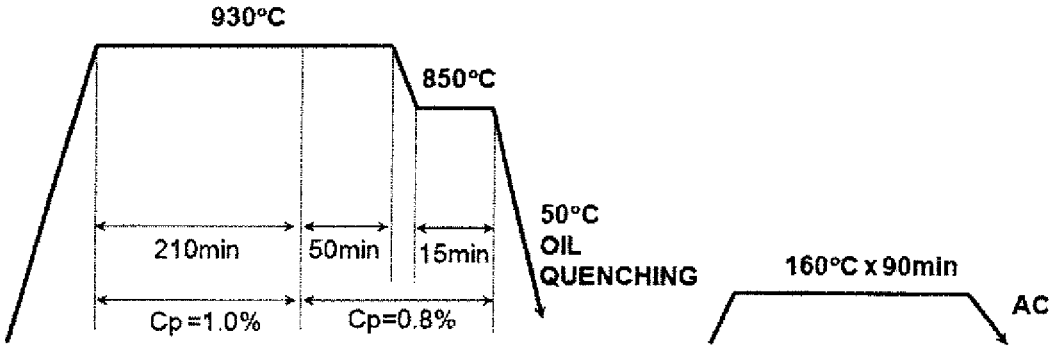
FIG. 7 is a diagram showing a heat pattern of "carburizing-quenching-tempering" performed on the test specimen shown in FIG. 4 using Steel 13 as a material in Example.

Further, the rough shaped roller pitting large roller test specimen of Steel 13 was subjected to "carburizing-quenching-tempering" in the heat pattern shown in FIG. 7. In FIG. 7 as well, as in FIG. 6, "Cp" represents carbon potential. Also, "50° C. OIL QUENCHING" indicates that quenching was performed by plunging the test specimen into oil with an oil temperature of 50° C. Further, "AC" represents air cooling.

Figure 8:
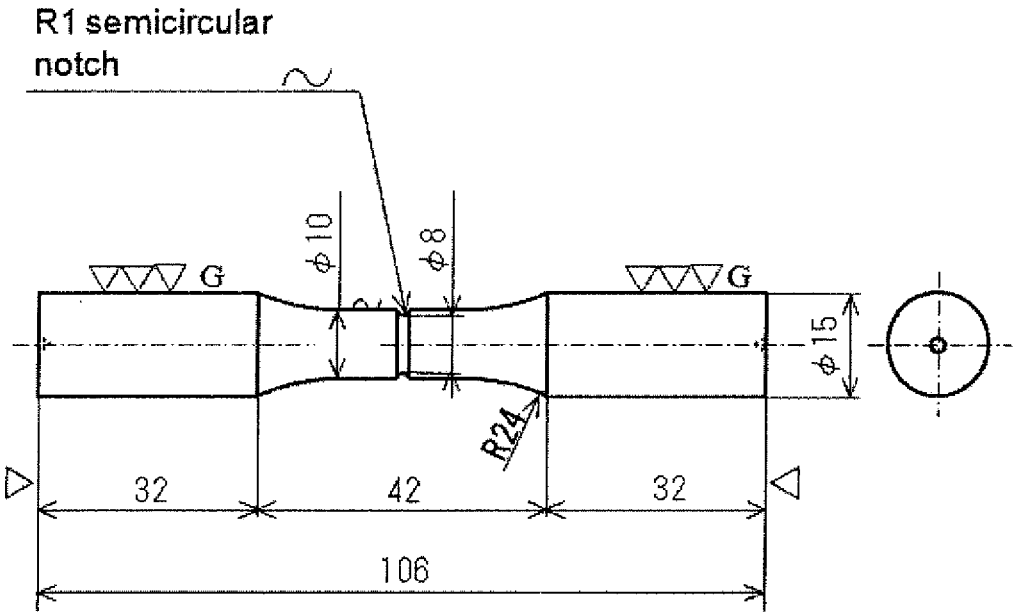
FIG. 8 is views showing the finished shape of a notched Ono type rotating bending fatigue test specimen that is used in Example. The unit of each dimension in the figure is "mm".
Figure 9:
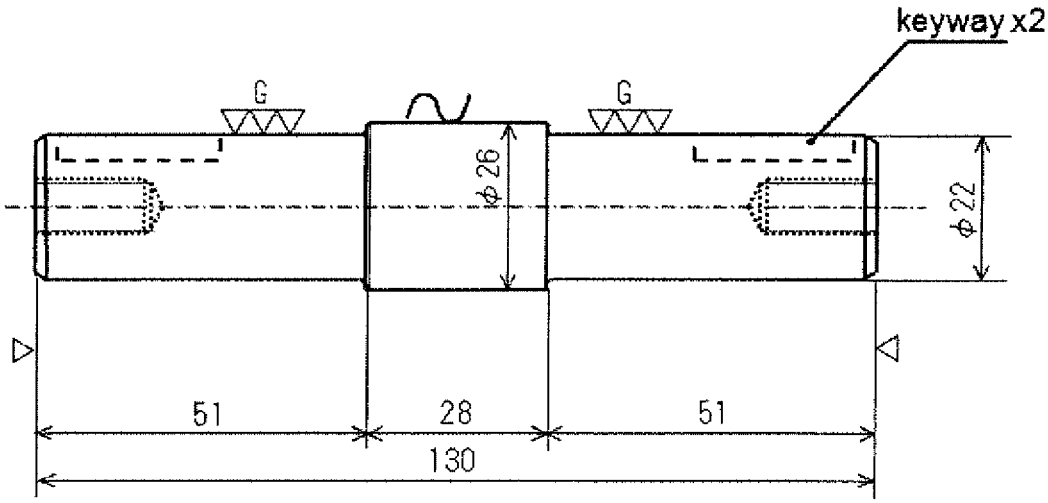
FIG. 9 is a view showing the finished shape of a roller pitching small roller test specimen that is used in Example. The unit of each dimension in the figure is "mm".
Figure 10:
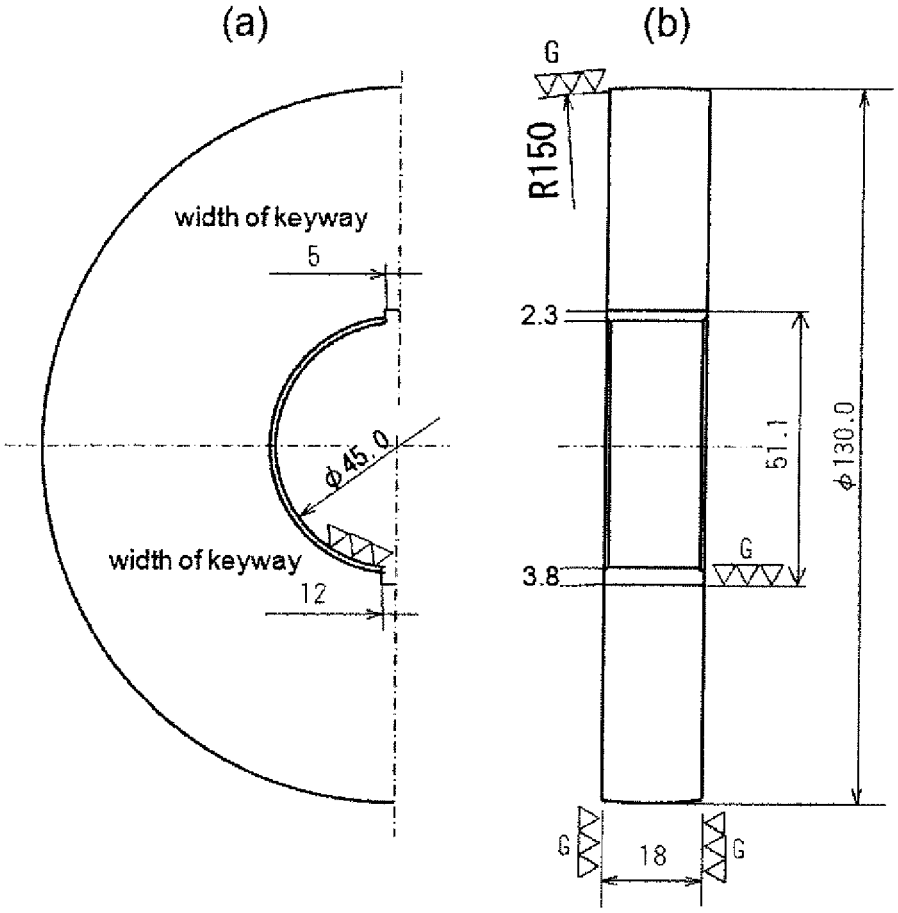
FIG. 10 is views showing the finished shape of a roller pitching large roller test specimen that is used in Example.

The rough shaped test specimens that have been subjected to "gas nitrocarburizing/oil cooling" or "carburizing-quenching-tempering" were finish-worked to prepare the notched Ono type rotating bending fatigue test specimen shown in FIG. 8, the roller pitting small roller test specimen shown in FIG. 9, and the roller pitting large roller test specimen shown in FIG. 10. In FIG. 10, FIG. 10(*a*) is a front view in the case where the roller pitching large roller test specimen is cut in half on the centerline, and FIG. 10(*b*) is a sectional view taken on the centerline.

The units of all the dimensions of the test specimens shown in FIGS. 8 to 10 are "mm". The finishing symbols of two kinds shown in FIGS. 8 to 10 are, as in FIGS. 1 to 4, the "triangle symbols" representing surface roughness described in Explanation table 1 of JIS B 0601 (1982).

Also, letter "G" attached to the finishing symbol is an abbreviation of working method showing "grinding" specified in JIS B 0122 (1978).

Further, "~" is a "waveform symbol" indicating that the surface is a base-metal one, that is, a surface in a state of being subjected to "gas nitrocarburizing/oil cooling" or "carburizing-quenching-tempering".

By using the test specimens having been prepared as described above, tests described in the following <<1>> to <<7>> were conducted.

<<1>> Vickers Hardness Test on Test Specimen in State of being Hot-Forged or Having been Normalized The HV hardness was measured at a total of five points, consisting of one point in a central portion and four points in an R/2 portion ("R" represents the radius of steel bar) of the Vickers hardness test specimen, which is in a state of being hot-forged or having been normalized, by using a Vickers hardness tester with the test force being 9.8 N in conformity to "Vickers hardness test—test method" described in JIS Z 2244 (2009). The arithmetic mean value of HV hardness values at the five points was made the HV hardness in a state of being hot-forged or having been normalized.

<<2>> Micro-Structure Observation in State of Being Hot-Forged or Having Been Normalized The micro-structure observation specimen in a state of being hot-forged or having been normalized was etched with nital, and the R/2 portion was observed under an optical microscope with the magnification being ×400.

As the result, the micro-structure was any of bainite, a two-phase mixed structure consisting of ferrite and bainite, a two-phase mixed structure consisting of ferrite and pearlite, and a three-phase mixed structure consisting of ferrite, pearlite, and bainite.

<<3>> Lathe Turning Test

By using the lathe turning test specimen, a lathe turning test was conducted under the conditions described below.

Tool: Cemented carbide tool (material symbol: CA5525)

Circumferential speed: 360 m/min

Feed: 0.4 mm/rev

Depth of cut: 1 mm

Lubricant: Water-soluble lubricant

The cutting resistance at the time of lathe turning was measured. When the cutting resistance was 750 N or less, it was evaluated that the machinability is good.

Further, the chips formed at the time of lathe turning were also observed to evaluate the chip disposal ability. When the chips were cut in pieces and there did not occur a trouble such that the chips twined around the material being tested, it was judged that "the chip disposal ability is good", and on the other hand, when the chips are long and there occurred a trouble such that the chips twined around the material being tested, it was judged that "the chip disposal ability is poor".

<<4>> Measurement of Amount of Expansion Caused "Gas Nitrocarburizing/Oil Cooling" or "Carburizing-Quenching-Tempering"

Figure 11:
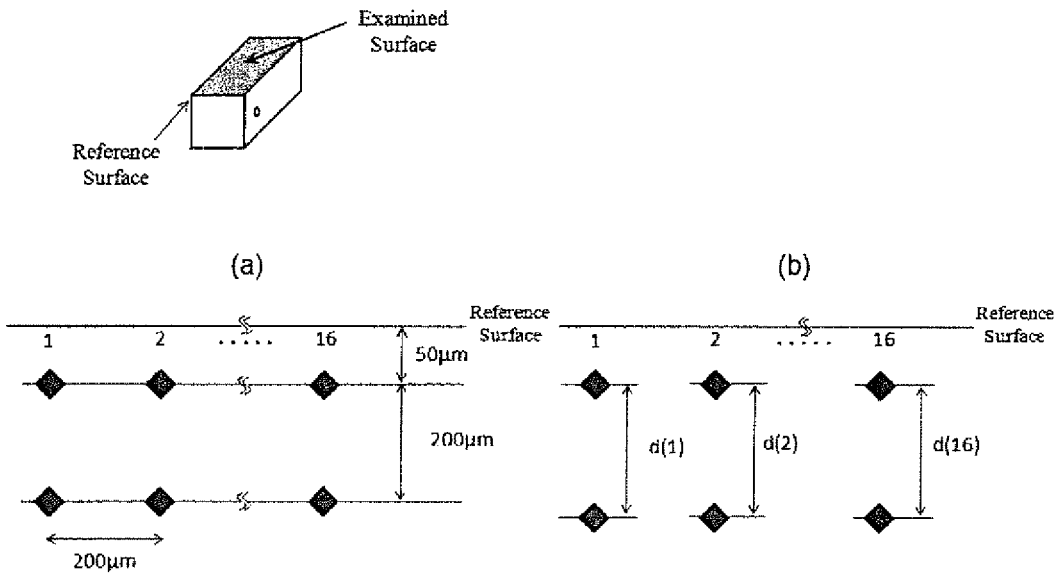
FIG. 11 is a view and diagrams for explaining a method for examination conducted to measure the amount of expansion caused by "gas nitrocarburizing" or "carburizing-quenching-tempering".

First, indentations were formed by using a Vickers hardness tester with the test force being 0.98 N at a total of 32 places including 16 places of position Nos. 1A to 16A that were 50 μm deep from the reference surface and 200 μm spaced in the expansion measuring test specimen shown in FIG. 1 and 16 places of position Nos. 1B to 16B that were further 200 μm deep from the position Nos. 1A to 16A and 200 μm spaced as shown in FIG. 11(*a*). In FIG. 11, only "1 to 16" that are position numbers are shown, and symbols "A" and "B" showing the depth position are omitted.

Next, the test specimens of Steels 1 to 12 on which the indentations had been formed were subjected to the "gas nitrocarburizing/oil cooling" in the heat pattern shown in FIG. 5, and also the test specimen of Steel 13 on which the indentations had been formed were subjected to the "carburizing-quenching-tempering" in the heat pattern shown in FIG. 6.

After the "gas nitrocarburizing/oil cooling" or "carburizing-quenching-tempering" had been performed, on each of the test specimens, the distance d(n) at 16 places between the indentations formed at position No. nA and position No. nB (n represents an integer of 1 to 16) was measured. In the case where the indentations after the "gas nitrocarburizing/oil cooling" or "carburizing-quenching-tempering" were obscure, the distance d(n) between the indentations was measured after the surface to be examined had been buffed lightly.

The amount of expansion was calculated by the following Formula:

$$[\{d(1)+d(2)+\ldots+d(n)\}-16\times 200]/16$$

<<5>> Measurement of Surface Hardness, Core Hardness, and Effective Case Depth After "Gas Nitrocarburizing/Oil Cooling" or "Carburizing-Quenching-Tempering"

By using the roller pitting small roller test specimen before testing, which had been finish-worked after "gas nitrocarburizing/oil cooling" or "carburizing-quenching-tempering", a portion thereof having a diameter of 26 mm was transversely cut. After a cut specimen had been embedded in a resin so that the cut surface was a surface to be examined, the cut surface was polished so as to be of mirror finish, and the surface hardness, core hardness, and effective case depth were examined by using a Vickers hardness tester.

Specifically, the HV hardnesses were measured at optional 10 points at a position 0.03 mm deep from the surface of test specimen by using a Vickers hardness tester with the test force being 0.98 N in conformity to "Vickers hardness test—test method" described in JIS Z 2244 (2009). The arithmetic mean value of the measurement values was made the "surface hardness".

Also, by using the same resin-embedded specimen, as in the above-described case, the HV hardnesses were measured at optional 10 points at a position 2 mm deep from the surface of test specimen by using a Vickers hardness tester with the test force being 1.96 N. The arithmetic mean value of the measurement values was made the "core hardness".

Further, by using the same resin-embedded specimen, as in the above-described case, the HV hardnesses were measured at predetermined intervals in the direction directed from the surface of test specimen toward the center thereof by using a Vickers hardness tester with the test force being 1.96 N, and thereby an HV harness distribution chart was prepared. The distance from the surface to a position at which the HV hardness is 420 was made the effective case depth.

<<6>> Ono Type Rotating Bending Fatigue Test

By using the Ono type rotating bending fatigue test specimen having been finish-worked, an Ono type rotating bending fatigue test was conducted under the conditions described below, and the "rotating bending fatigue strength" was evaluated by the maximum strength at which rupture did not occur at a number of cycles of $10^7$.

In the case where a steel had a rotating bending fatigue strength equivalent to or higher than that of Test No. 13 in which "carburizing-quenching-tempering" was performed by using Steel 13 corresponding to SCr420H specified in JIS G 4052 (2008), the bending fatigue strength was made excellent.

Temperature: Room temperature

Atmosphere: In the air

Rotating speed: 3000 rpm

<<7>> Roller Pitting Test

By using the roller pitting small roller test specimen and the roller pitting large roller test specimen, which had been finish-worked, a roller pitting test was conducted under the conditions described below, and the life duration at the time when pitting with a size on the major axis of 1 mm or larger occurred was measured. The above-described test was conducted three times, and the average life duration of three times was made a "pitting life". The evaluated number of cycles was $1\times10^7$ at the maximum.

In the case where a steel had a pitting life exceeding $1\times10^7$ cycles equivalent to or longer than that of test No. 13 in which "carburizing-quenching-tempering" was performed by using Steel 13 corresponding to SCr420H specified in JIS G 4052 (2008), it was evaluated that the steel had a high surface fatigue strength.

Slip factor: 40%

Interfacial pressure: 1600 MPa

Rotating speed of small roller test specimen: 1000 rpm

Lubrication: Performed by spraying lubricating oil for automatic transmission having an oil temperature of 100° C. onto the contact portion of the roller pitting small roller test specimen and the roller pitting large roller test specimen at a rate of 2 litters per minute The "slip factor" is a value calculated by the following Formula:

$$\{(V2-V1)/V1\}\times100$$

where, "V1" is the tangential speed of the surface of the roller pitting small rolling test specimen, and "V2" is the tangential speed of the surface of the roller pitting large rolling test specimen.

Table 2 summarizes the test results obtained from the examinations using the test specimens sampled from the state of being hot-forged or the test specimens sampled after having been "normalized".

Symbols "B", "F", and "P" in the "Micro-structure" column in Table 2 mean bainite, ferrite, and pearlite, respectively. Also, in a column of "chip disposal ability", symbol ○ indicates that chips are cut in pieces and there does not occur a trouble such that the chips "twine" around the material being tested, that is, "the chip disposal ability is good", and symbol x indicates that the chips are long and there occurs a trouble such that the chips twine around the material being tested, that is, "the chip disposal ability is poor".

Table 3 summarizes the test results obtained from the tests using the test specimens that are finish-worked after the "gas nitrocarburizing/oil cooling" or "carburizing-quenching-tempering".

TABLE 2

| | Test No. | Steel | Hardness (HV) | Micro-structure | Cutting resistance (N) | Chip disposal ability |
|---|---|---|---|---|---|---|
| Inventive Examples | 1 | 1 | 165 | F + P | 680 | ○ |
| | 2 | 2 | 167 | F + P | 690 | ○ |
| | 3 | 3 | 184 | F + P + B | 696 | ○ |
| | 4 | 4 | 170 | F + P | 684 | ○ |
| | 5 | 5 | 210 | F + P + B | 711 | ○ |
| Comparative Examples | 6 | *6 | 240 | F + B | 720 | ○ |
| | 7 | *7 | 320 | B | 825 | ○ |
| | 8 | *8 | 85 | F + P | 650 | x |
| | 9 | *9 | 158 | F + P | 675 | ○ |
| | 10 | *10 | 245 | F + B | 775 | ○ |
| | 11 | *11 | 160 | F + P | 690 | ○ |
| | 12 | *12 | 285 | B | 805 | ○ |
| | 13 | *13 | 165 | F + P | 690 | ○ |

Symbols "F", "P" and "B" in the "Micro-structure" column mean ferrite, pearlite and bainite, respectively.
*indicates that chemical compositions fall outside the range defined in the present invention.

TABLE 3

| | Test No. | Steel | Amount of expansion (μm) | Surface hardness (HV) | Core hardness (HV) | Effective case depth (mm) | Ono type rotating bending fatigue strength (MPa) | Pitting life (cycles) |
|---|---|---|---|---|---|---|---|---|
| Inventive Examples | 1 | 1 | 1.8 | 715 | 168 | 0.21 | 450 | $>1.0\times10^7$ |
| | 2 | 2 | 1.8 | 725 | 170 | 0.25 | 460 | $>1.0\times10^7$ |
| | 3 | 3 | 2.0 | 745 | 189 | 0.24 | 470 | $>1.0\times10^7$ |
| | 4 | 4 | 2.0 | 778 | 175 | 0.24 | 500 | $>1.0\times10^7$ |
| | 5 | 5 | 2.1 | 750 | 220 | 0.29 | 510 | $>1.0\times10^7$ |
| Comparative Examples | 6 | *6 | 2.6 | 781 | 253 | 0.22 | 500 | $>1.0\times10^7$ |
| | 7 | *7 | 3.0 | 778 | 345 | 0.21 | 530 | $>1.0\times10^7$ |
| | 8 | *8 | 0.9 | # 615 | # 80 | # 0.07 | 350 | $1.5\times10^5$ |
| | 9 | *9 | 1.6 | # 640 | 165 | # 0.12 | 390 | $2.0\times10^6$ |
| | 10 | *10 | 1.8 | 710 | 255 | 0.21 | 420 | $5.8\times10^6$ |
| | 11 | *11 | 2.0 | # 649 | 170 | # 0.11 | 400 | $6.1\times10^6$ |

TABLE 3-continued

| Test No. | Steel | Amount of expansion (μm) | Surface hardness (HV) | Core hardness (HV) | Effective case depth (mm) | Ono type rotating bending fatigue strength (MPa) | Pitting life (cycles) |
|---|---|---|---|---|---|---|---|
| 12 | *12 | 2.5 | 745 | 298 | 0.32 | 460 | $>1.0 \times 10^7$ |
| 13 | *13 | 4.1 | 658 | 305 | 0.75 | $ 430 | $ $>1.0 \times 10^7$ |

Test Nos. 1-12 are results obtained from the tests using the test specimens that are finish-worked after the "gas nitrocarburizing/oil cooling" and Test No. 13 is result obtained from the test using the test specimen that is finish-worked after the "carburizing-quenching-tempering".
*indicates that chemical compositions fall outside the range defined in the present invention.

# indicates that surface hardness, core hardness or effective case depth of the nitrided component does not satisfy the condition defined in the present invention.
$ indicates the criteria for assessment.

From Tables 2 and 3, it is apparent that, for Test Nos. 1 to 5 using Steels 1 to 5 satisfying the conditions defined in the present invention as materials, the steels have a good machinability before nitrocarburizing, has a rotating bending fatigue strength exceeding 430 MPa that is the rotating bending fatigue strength of Test No. 13 subjected to "carburizing-quenching-tempering" by using Steel 13 corresponding to SCr420H specified in JIS G 4052 (2008), has a pitting life equivalent to that of Test No. 13, has a high bending fatigue strength after nitrocarburizing, and is excellent in pitting resistance.

In contrast, for Test Nos. 6 to 12 of comparative examples that do not satisfy the conditions defined in the present invention, the machinability decreases, the amount of expansion caused in nitriding is large, or the rotating bending fatigue strength and pitting life are poorer than those of Test No. 13 using the Steel 13.

Specifically, for Test No. 6, the Fn1 of Steel 6 used is as large as 2.38, exceeding the value defined in the present invention, so that the amount of expansion in nitriding is as large as 2.6 μm.

For Test No. 7, the contents of C and Mn of Steel 7 used are higher than the values defined in the present invention, and the HV hardness after normalizing is high. Therefore, the cutting resistance is 825 N, and the machinability is poor. Further, the Fn1 of Steel 7 is as large as 2.82, exceeding the value defined in the present invention, so that the amount of expansion in nitriding is as large as 3.0 μm.

For Test No. 8, since the contents of C and Cr of Steel 8 used are lower than the values defined in the present invention, the rotating bending fatigue strength and the pitting life are 350 MPa and $1.5\times10^5$ cycles, respectively, being poorer than those of Test No. 13 using Steel 13. Also, since the S content of Steel 8 is lower than the range defined in the present invention, the chip disposal ability is poor.

For Test No. 9, since the Cr content of Steel 9 used is lower than the value defined in the present invention, the rotating bending fatigue strength and the pitting life are 390 MPa and $2.0\times10^6$ cycles, respectively, being poorer than those of Test No. 13 using Steel 13.

For Test No. 10, since the contents of Ti, N, and O of Steel 10 used are higher than the values defined in the present invention, the bending fatigue strength and the pitting life are 420 MPa and $5.8\times10^6$ cycles, respectively, being poorer than those of Test No. 13 using Steel 13. Also, since the N content is higher than the value defined in the present invention, the cutting resistance is 775 N, so that the machinability is also poor.

For Test No. 11, since the V content of Steel 11 used is lower than the value defined in the present invention, the rotating bending fatigue strength and the pitting life are 400 MPa and $6.1\times10^6$ cycles, respectively, being poorer than those of Test No. 13 using Steel 13.

For Test No. 12, the contents of Mn and Mo of Steel 12 used are higher than the values defined in the present invention, and the HV hardness after normalizing is high. Therefore, the cutting resistance is 805 N, so that the machinability is poor.

INDUSTRIAL APPLICABILITY

The steel for nitriding of the present invention is easily subjected to cutting before nitriding, and moreover, the nitrided component produced by using this steel for nitriding as a material has a high bending fatigue strength and surface fatigue strength although the content of Mo, which is an expensive element, is as low as 0.05 mass % or less. Therefore, the steel for nitriding of the present invention is suitable for being used as a material for a nitrided component required to have a high bending fatigue strength and surface fatigue strength. Further, the steel for nitriding of the present invention is suitable as a material for a thin-wall nitrided component such as an automobile ring gear because the amount of expansion caused by nitriding is small.

What is claimed is:

1. A nitrided component having a chemical composition consisting of, by mass percent, C: 0.07 to 0.14%, Si: 0.10 to 0.30%, Mn: 0.4 to 1.0%, S: 0.005 to 0.030%, Cr: 1.0 to 1.5%, Mo: 0.05% or less (including 0%), Al: 0.010% or more to less than 0.10%, and V: 0.10 to 0.25%, Fn1 expressed by Formula (1) is 2.30 or less, and the balance of Fe and impurities, wherein P, N, Ti and O among the impurities are P: 0.030% or less, N: 0.008% or less, Ti: 0.005% or less, and O: 0.0030% or less, in which the surface hardness is 650 to 900 in Vickers hardness, the core hardness is 150 or higher in Vickers hardness, and the effective case depth is 0.15 mm or larger:

$$Fn1=0.61\mathrm{Mn}+1.11\mathrm{Cr}+0.35\mathrm{Mo}+0.47\mathrm{V} \quad (1)$$

where, the symbol of each element in Formula (1) represents the content thereof in mass percent.

2. A nitrided component having a chemical composition consisting of, by mass percent, C: 0.07 to 0.14%, Si: 0.10 to 0.30%, Mn: 0.4 to 1.0%, S: 0.005 to 0.030%, Cr: 1.0 to 1.5%, Mo: 0.05% or less (including 0%), Al: 0.010% or more to less than 0.10%, and V: 0.10 to 0.25%, Fn1 expressed by Formula (1) is 2.30 or less, at least one element selected from, by mass percent, Cu: 0.30% or less and Ni: 0.25% or less, and the balance of Fe and impurities, wherein P, N, Ti and O among the impurities are P: 0.030% or less, N: 0.008% or less, Ti: 0.005% or less, and O: 0.0030% or less, in which the surface hardness is 650 to 900 in Vickers hardness, the core hardness is 150 or higher in Vickers hardness, and the effective case depth is 0.15 mm or larger:

$$Fn1=0.61\mathrm{Mn}+1.11\mathrm{Cr}+0.35\mathrm{Mo}+0.47\mathrm{V} \quad (1)$$

where, the symbol of each element in Formula (1) represents the content thereof in mass percent.

* * * * *